US007918647B1

(12) United States Patent
Liang

(10) Patent No.: US 7,918,647 B1
(45) Date of Patent: Apr. 5, 2011

(54) TURBINE AIRFOIL WITH FLOW BLOCKING INSERT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 12/636,759

(22) Filed: Dec. 13, 2009

Related U.S. Application Data

(63) Continuation of application No. 11/472,248, filed on Jun. 21, 2006, now abandoned.

(51) Int. Cl.
*F01D 5/18* (2006.01)

(52) U.S. Cl. ..... 416/96 A

(58) Field of Classification Search ..... 416/96 A, 416/97 R

See application file for complete search history.

(56) References Cited

U.S. PATENT DOCUMENTS

| | | | | |
|---|---|---|---|---|
| 3,902,820 | A * | 9/1975 | Amos | 416/96 A |
| 4,753,575 | A * | 6/1988 | Levengood et al. | 416/97 R |
| 5,090,866 | A * | 2/1992 | Blair | 416/97 R |
| 2006/0280606 | A1 * | 12/2006 | Busbey et al. | 416/97 R |

* cited by examiner

*Primary Examiner* — Richard Edgar
(74) *Attorney, Agent, or Firm* — John Ryznic

(57) ABSTRACT

An airfoil used in a turbine of a gas turbine engine, the airfoil having a blocker insert formed within the serpentine cooling passage of the airfoil. The blocker insert forms a cooling air passage between the serpentine passage within the blade and the outer surface of the blocker insert. The blocker insert is formed of a carbon/carbon composite material and is cast into the airfoil when the airfoil is formed. A ceramic layer is applied over the blocker insert to produce a composite insert prior to casting the airfoil. The ceramic layer on the insert is then leached off to form the finished airfoil with the reduced size cooling air passage within the airfoil. The blocker insert can be formed with a cooling air passage therein in order to provide additional cooling for the finished airfoil.

3 Claims, 4 Drawing Sheets

TURBINE AIRFOIL WITH FLOW BLOCKING INSERT

CROSS-REFERENCE TO RELATED APPLICATIONS

This application is a CONTINUATION of U.S. patent application Ser. No. 11/472,248 filed on Jun. 21, 2006 and entitled TURBINE AIRFOIL WITH A FLOW BLOCKING INSERT.

STATEMENT REGARDING FEDERALLY SPONSORED RESEARCH OR DEVELOPMENT

None.

BACKGROUND OF THE INVENTION

1. Field of the Invention

The present invention relates generally to airfoils in a gas turbine engine, and more specifically to an insert located within a cooling air passage of the airfoil.

2. Description of the Related Art Including Information Disclosed Under 37 CFR 1.97 and 1.98

A gas turbine engine produces mechanical work from combustion of a fuel. The gas turbine engine has a compressor to supply a compressed air to a combustor, where a fuel is mixed and burned with the compressed air to produce a hot gas flow. The hot gas flow is passed through a turbine to convert the hot gas flow into mechanical work by driving the turbine shaft.

The efficiency of the gas turbine engine can be improved by operating the turbine at higher temperatures. Because the operating temperature of the turbine is above the safe operating temperature of the materials used to make parts of the turbine, such as the blades and vanes (both considered to be airfoils), the airfoils in the turbine section are cooled by passing a fluid such as compressed air through cooling passages formed within the airfoils. Improved cooling of the airfoils can allow for higher turbine operating temperatures, resulting in improved performance.

A Prior Art turbine blade is shown in FIG. 1 with an aft flowing triple pass (3-pass) serpentine cooling passage for an all convectively cooled blade. A cross sectional view of the blade is shown in FIG. 2. In the Prior Art FIG. 1 blade 12, the blade leading edge is cooled with the first up pass of the multi-pass channel flow 14. The blade mid-chord is cooled with the second leg 15 of the serpentine down pass flow channel. The aft portion of the blade is cooled with the third leg 16 of the serpentine flow channel in conjunction with a plurality of trailing edge exit discharge cooling holes 17. As the cooling air flow rate is reduced, the internal through flow velocity within the serpentine flow channels will be reduced, resulting in a low internal heat transfer rate coefficient and low internal cooling capability. For an airfoil that is designed with large internal flow cavities and low cooling flow rate, lowering the cooling flow rate to improve efficiency would result in less cooling of the airfoil. To provide adequate cooling of the airfoil with this design, a large volume of cooling air must be passed through the airfoil. Since the cooling air for the airfoil is generally from the compressor at high pressure, much of the cooling air is wasted. One way to retain the high internal cooling performance for a low cooling flow rate design with large internal serpentine flow cavity is by reducing the internal through flow area.

It is an object of the present invention to improve the blade cooling of an airfoil that is designed for a low cooling flow rate and large internal flow cavities while still using a low cooling air flow rate.

It is another object of the present invention to provide cooling air flow to both the pressure side wall and suction side wall of the airfoil while maintaining a high flow rate through the airfoil cooling passages and therefore have a high heat transfer coefficient.

BRIEF SUMMARY OF THE INVENTION

An airfoil used in a gas turbine engine, the airfoil includes an internal cooling air passage in which cooling air passes through to provide cooling for the airfoil. The cooling air passage within the airfoil includes a flow blocker within the serpentine channels, the flow blocker being so shaped and sized as to occupy most of the volume of the serpentine channel in order to reduce the flow area through the airfoil. The cooling air is kept in contact with the hot sections of the serpentine channel in order to cool the airfoil, while maintaining a high flow rate of the cooling air due to the decreased flow volume because of the flow blocker. The flow blocker is cast into the airfoil when the airfoil is cast.

DETAILED DESCRIPTION OF THE INVENTION

The present invention is a turbine airfoil used in a gas turbine engine, the airfoil having a serpentine cooling channel for passing cooling air to cool the airfoil, where the serpentine channel includes a flow blocking insert formed within the channel to block the flow of cooling air within the channel. A turbine includes both rotary blades and stationary vanes or nozzles that both require cooling. An airfoil is therefore considered to include both blades and vanes.

Figure 1:
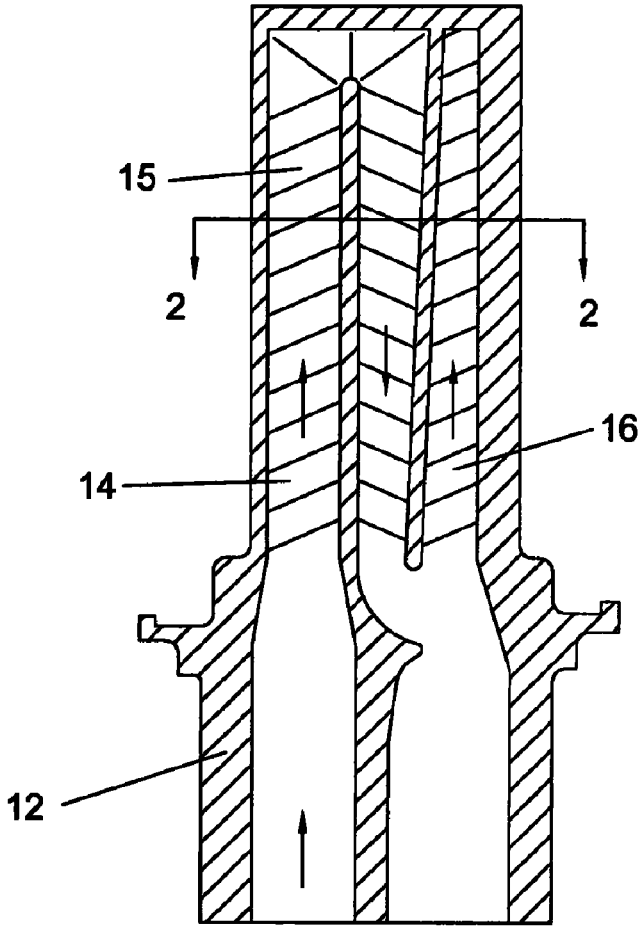
Fig 1 Prior Art
FIG. 1 shows a cut-away view of a Prior Art turbine blade with a serpentine flow channel therein.
Figure 2:
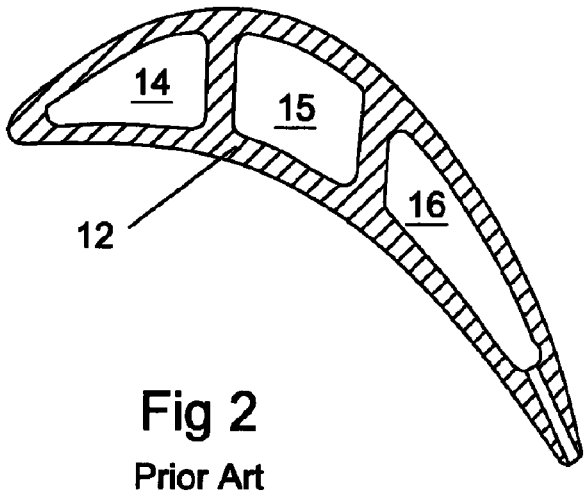
Fig 2 Prior Art
FIG. 2 shows a cross section view through line 2-2 of the turbine blade of FIG. 1.
Figure 3:
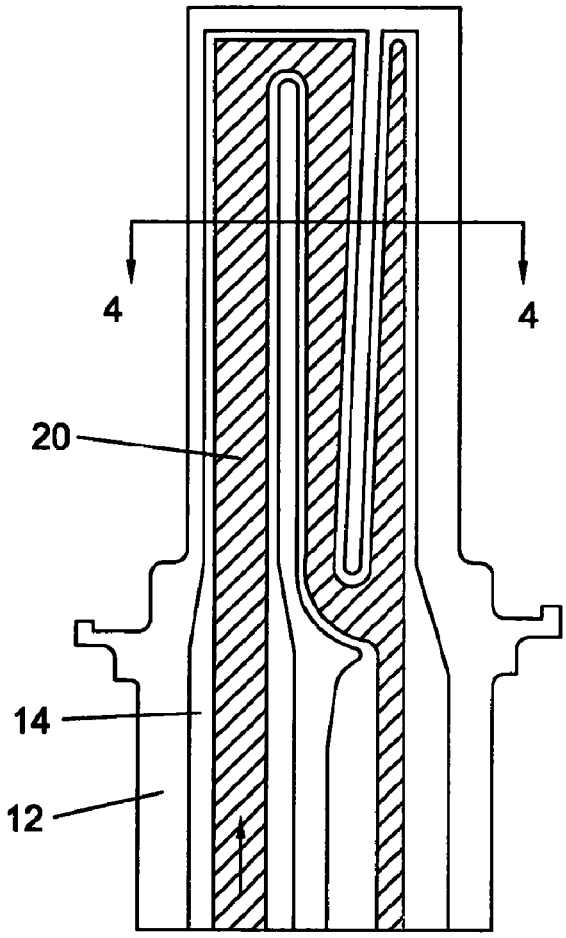
FIG. 3 shows a cut-away view of the turbine blade of the present invention with the flow blocker within the serpentine channel.
Figure 4:
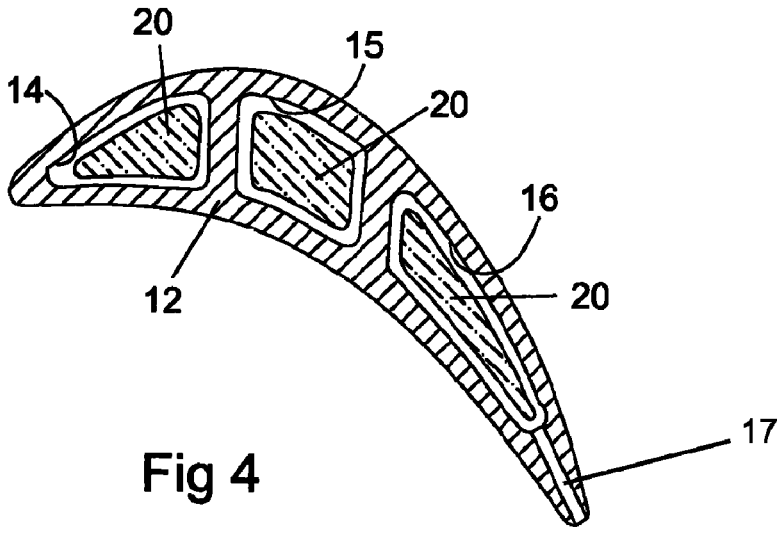
FIG. 4 shows a cross section view through line 4-4 of the turbine blade of FIG. 3.
Figure 5:
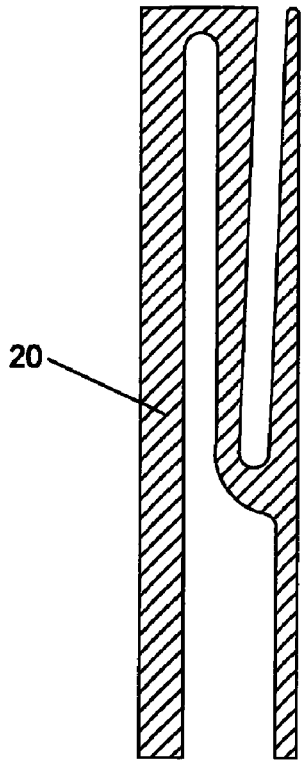
FIG. 5 shows a side view of the flow blocker cast used in the serpentine channel of the turbine blade of the present invention.

FIGS. 3 and 4 both show the turbine blade 12 of the present invention with the flow blocker insert 20. The turbine blade 12 includes a cooling flow passage therein for passing cooling air to cool the blade, and has the size and shape of the Prior Art FIG. 1 blade. A new turbine blade with a different serpentine flow path could also be used with the blocker insert of the present invention. The blade 12 includes a 3-pass serpentine cooling channel with a first leg 14, a second leg 15, and a third leg 16 as in the Prior Art. The turbine blade of the present invention, however, includes a flow blocker insert 20. The blocker insert 20 is sized and shaped to occupy the cooling channel to decrease the size of the cooling air flow passage within the channel in order that a low cooling air flow volume can be used while maintaining a high flow rate to adequately cool the blade. FIG. 4 shows a cross section view of the blade in FIG. 3. The first leg 14, the second leg 15, and the third leg 16 of the serpentine channel is shown in FIG. 4, and the blocker insert 20 is shown forming a flow space between the internal wall of the channel and the outer wall of the blocker insert 20. The blocker insert 20 is formed into the blade when the blade is cast. Because of this, the blocker insert 20 is made of a high temperature resistant material in order that the insert can withstand the blade casting process. The blocker insert 20 in this embodiment is made from a carbon-fiber composite. However, other materials can be used.

Figure 6:
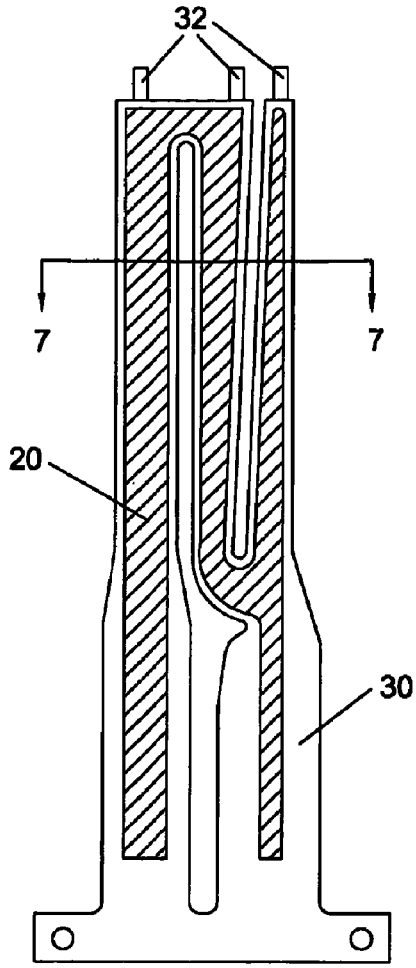
FIG. 6 shows a side view of the flow blocker with an external ceramic core on the outside surface.
Figure 7:
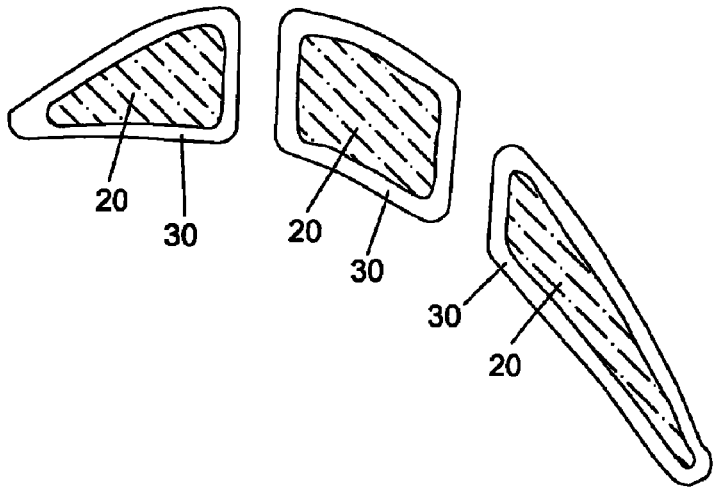
FIG. 7 shows a cross section view of the flow blocker through line 7-7 of FIG. 6.

The turbine blade with the blocker insert 20 is formed according to the following process. The blocker insert 20 is formed in any well known method such as injection molding. The blocker insert 20 is then placed into a core die that has an internal shape of the finished serpentine path in the blade. The ceramic material that forms the outer ceramic layer 30 is inserted into the core die and hardens over the blocker insert 20. Ceramic core printouts 32 are formed on the ceramic layer 30 at the tip to be used to position the blocker insert in a die. U.S. Pat. No. 6,915,840 B2 issued to Devine, II et al on Jul. 12, 2005 and entitled METHODS AND APPARATUS FOR FABRICATING TURBINE ENGINE AIRFOILS discloses this process, and is incorporated herein by reference. The resulting composite blocker insert as shown in FIGS. 6 and 7 (insert 20 plus the ceramic layer 30) is then placed into a wax die that will be used in a lost wax casting process to form the blade. The composite insert (20+30) is placed into a ceramic mold that will form the blade over the composite insert. When the blade with the composite insert has cooled, the ceramic layer is leached out and the desired cooling air passage is formed where the ceramic layer used to be. U.S. Pat. No. 5,332,023 issued to Mills on Jul. 26, 1994 and entitled LEACHING OF CERAMIC MATERIALS and U.S. Pat. No. 6,739,380 issued to Schlienger et al on May 25, 2004 and entitled METHOD AND APPARATUS FOR REMOVING CERAMIC MATERIAL FROM CAST COMPONENTS discloses a leaching process that can be used to form the airfoil with the insert of the present invention, and both patents are incorporated herein by reference. U.S. Pat. No. 6,068,806 issued to Dietrich on May 30, 2000 and entitled METHOD OF CONFIGURING A CERAMIC CORE FOR CASTING A TURBINE BLADE discloses a process for casting a blade with a ceramic core therein, and is incorporated herein by reference. The Dietrich process can be used to cast the airfoil with the insert of the present invention.

Figure 8:
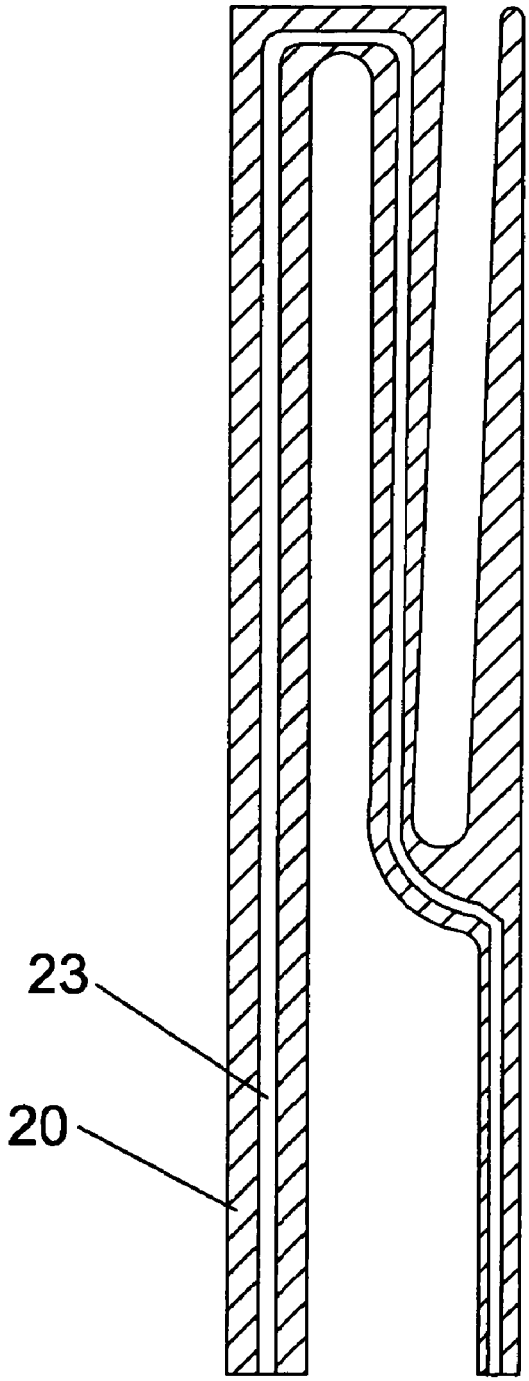
FIG. 8 shows a cross section view of an alternative embodiment of the flow blocker.

FIG. 8 shows an alternate embodiment of the composite insert of the present invention. In FIG. 8, the composite insert includes a cooling air passage 23 within the blocker insert portion 20 to provide for a cooling air passage within the composite insert. When the blade is formed with the composite insert therein, the cooling passage 23 within the insert can be used to provide additional cooling to the blade.

The present invention described forming a turbine airfoil such as a turbine blade. However, the present invention could also be used to form a turbine vane or nozzle with a blocker insert formed within the cooling air flow path. The present invention could be used in any type of high temperature apparatus that includes a cooling fluid passage therein in which a need arises to reduce the cross section flow area of the cooling fluid channel by placing an insert blocker therein.

I claim the following:

1. A turbine airfoil comprising:

an airfoil having a cooling passage therein;

a blocker insert located within the cooling passage;

the cooling passage is a serpentine cooling passage;

the blocker insert has a serpentine shape substantially equal to the shape of the serpentine cooling passage; and, a peripheral flow space is formed between the internal wall of the cooling passage and the outer wall of the blocker insert.

2. The turbine airfoil of claim 1, and further comprising:

the blocker insert is formed into the airfoil.

3. The turbine airfoil of claim 1, and further comprising:

the blocker insert is formed from a carbon fiber reinforced composite material.

* * * * *